US006322066B1

(12) United States Patent
Rong

(10) Patent No.: US 6,322,066 B1
(45) Date of Patent: Nov. 27, 2001

(54) LOTTERY TICKET DISPENSING ASSEMBLY

(76) Inventor: Chern-Bao Rong, P.O. Box 453, Taichung (TW)

( * ) Notice: Subject to any disclaimer, the term of this patent is extended or adjusted under 35 U.S.C. 154(b) by 0 days.

(21) Appl. No.: 09/571,390

(22) Filed: May 15, 2000

(51) Int. Cl.[7] ..... B65H 3/06; B65H 5/00

(52) U.S. Cl. ..... 271/119; 271/10.09; 271/18; 221/217

(58) Field of Search ..... 271/10.09, 18, 271/119; 221/217

(56) References Cited

U.S. PATENT DOCUMENTS 4,306,713 * 12/1981 Avritt et al. ..... 271/119 X
4,779,861 * 10/1988 Ozawa et al. ..... 271/119 X
5,098,078 * 3/1992 Nakanishi ..... 271/10.09 X
5,350,168 * 9/1994 Sheridan ..... 271/119 X
5,746,426 * 5/1998 Nakabayashi et al. ..... 271/119 X

* cited by examiner

*Primary Examiner*—Christopher P. Ellis
*Assistant Examiner*—Gene O. Crawford
(74) *Attorney, Agent, or Firm*—Harrison & Egbert

(57) ABSTRACT

A lottery ticket dispensing device is provided with a ticket drawing wheel having thereon a plurality of friction surfaces and smooth surfaces, which are arranged alternately so as to bring about an intermittent movement of a lottery ticket which is drawn out by the ticket drawing wheel. A fast-delivery roller of the dispensing device is provided with a gear engageable with a gear of the auxiliary roller of the dispensing device so as to cause the fast-delivery roller and the auxiliary roller to rotate synchronously to facilitate the prompt dispensing of the lottery tickets.

2 Claims, 6 Drawing Sheets

LOTTERY TICKET DISPENSING ASSEMBLY

FIELD OF THE INVENTION

The present invention relates generally to a machine for dispensing the lottery tickets, and more particularly to a dispensing wheel of the machine for dispensing the lottery tickets.

BACKGROUND OF THE INVENTION

As shown in FIGS. 1 and 2, a lottery ticket dispensing machine 10 of the prior art comprises a friction roller 11 and a support base 12 located behind the friction roller 11 for carrying a lottery ticket 13 and a weight 14. Located in front of the friction roller 11 is a guide plate 16 which has at the center thereof an opening 15. The guide plate 16 is provided on the rear segment thereof with a ticket stopping plate 17 and on the front segment thereof with an electric eye device 18. The lottery ticket 13 is pushed out between the bottom edge of the ticket stopping plate 17 and the guide plate 16 by the friction roller 11. The electric eye device 18 is intended to count the number of the lottery tickets 13 which have been forced out by the friction roller 11. Located over the opening 15 are a differential roller 19 and an auxiliary roller 20 for dispensing the lottery ticket 13. The friction roller 11 and the differential roller 19 are provided respectively with a bull gear 21 and a pinion 22 engageable with the bull gear 21 which is driven by the driving gear 24 of a motor 23. The differential effect is attained by the differential roller 19 capable of rotating at a faster rate than the friction roller 11.

The lottery ticket dispensing machine 10 of the prior art is defective in design in that it is incapable of registering the precise counts of the lottery tickets 13 that have been dispensed. Such a defect as described above is attributable to the fact that the second lottery ticket 13 is pushed out by the friction roller 11 even before the first lottery ticket 13 is dispensed by the differential roller 19 and the auxiliary roller 20, and that two or more lottery tickets 13 are superimposed in the midst of a dispensing process, thereby resulting erroneously in only one count by the electric eye device 18.

SUMMARY OF THE INVENTION

It is therefore the primary objective of the present invention to provide a lottery ticket dispensing device capable of dispensing the lottery tickets with precision.

The foregoing objective, features, functions and advantages of the present invention will be more readily understood upon a thoughtful deliberation of the following detailed description of the present invention in conjunction with the accompanying drawings.

DETAILED DESCRIPTION OF THE INVENTION

Figure 1:
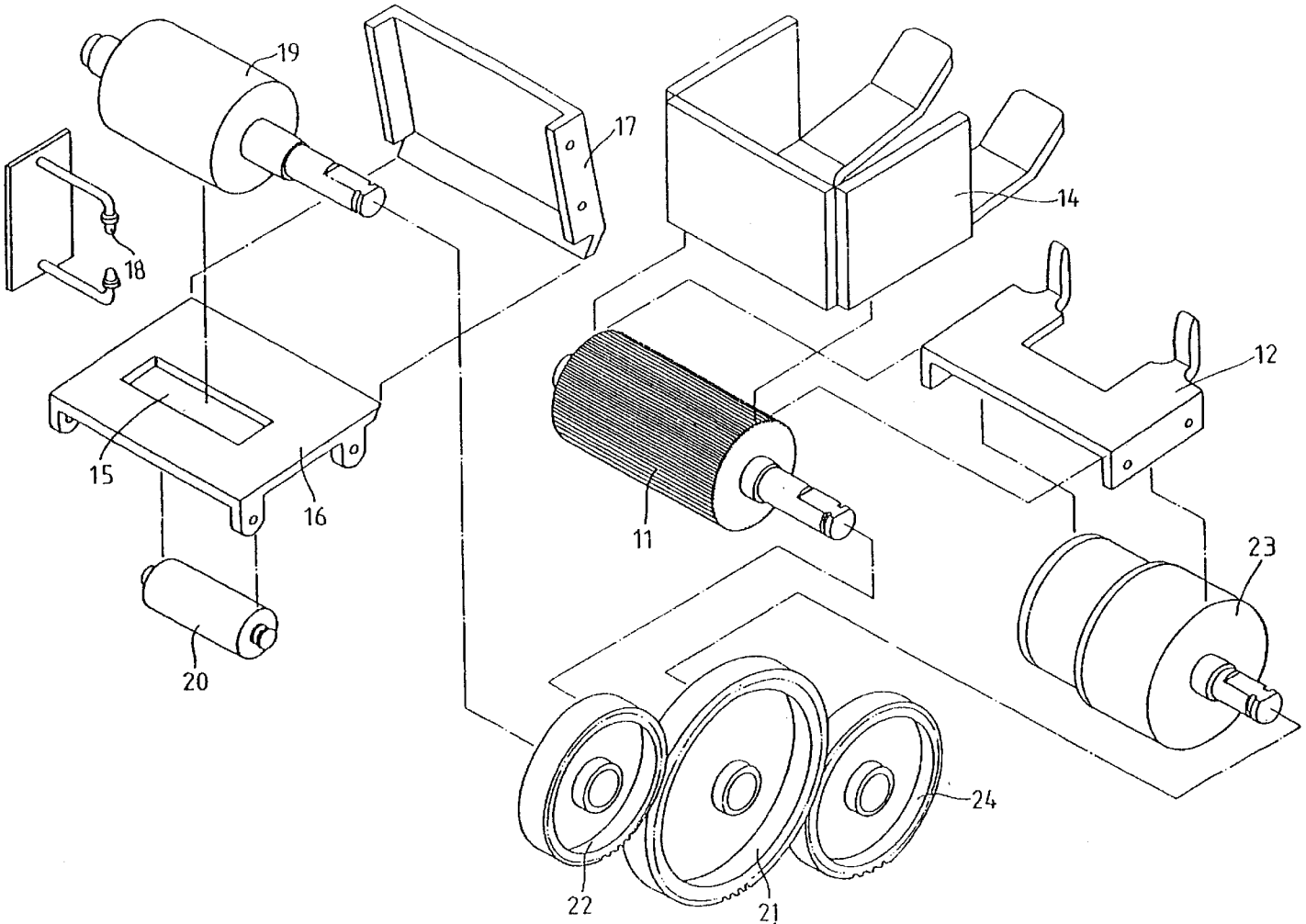
FIG. 1 (PRIOR ART)
FIG. 1 shows an exploded view of a lottery ticket dispensing machine of the prior art.
Figure 2:
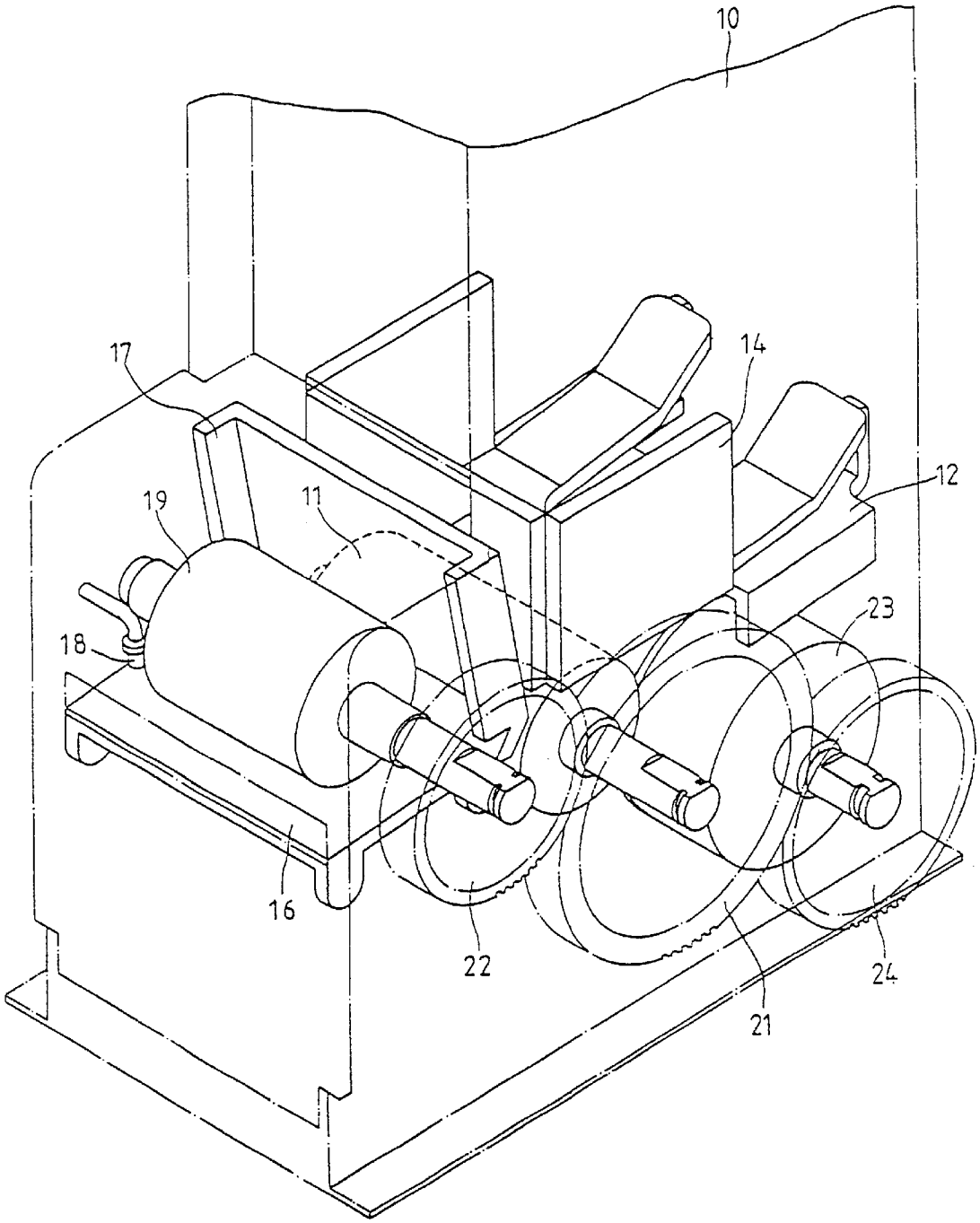
FIG.2 (PRIOR ART)
FIG. 2 shows a perspective view of the prior art lottery ticket dispensing machine in combination.
Figure 3:
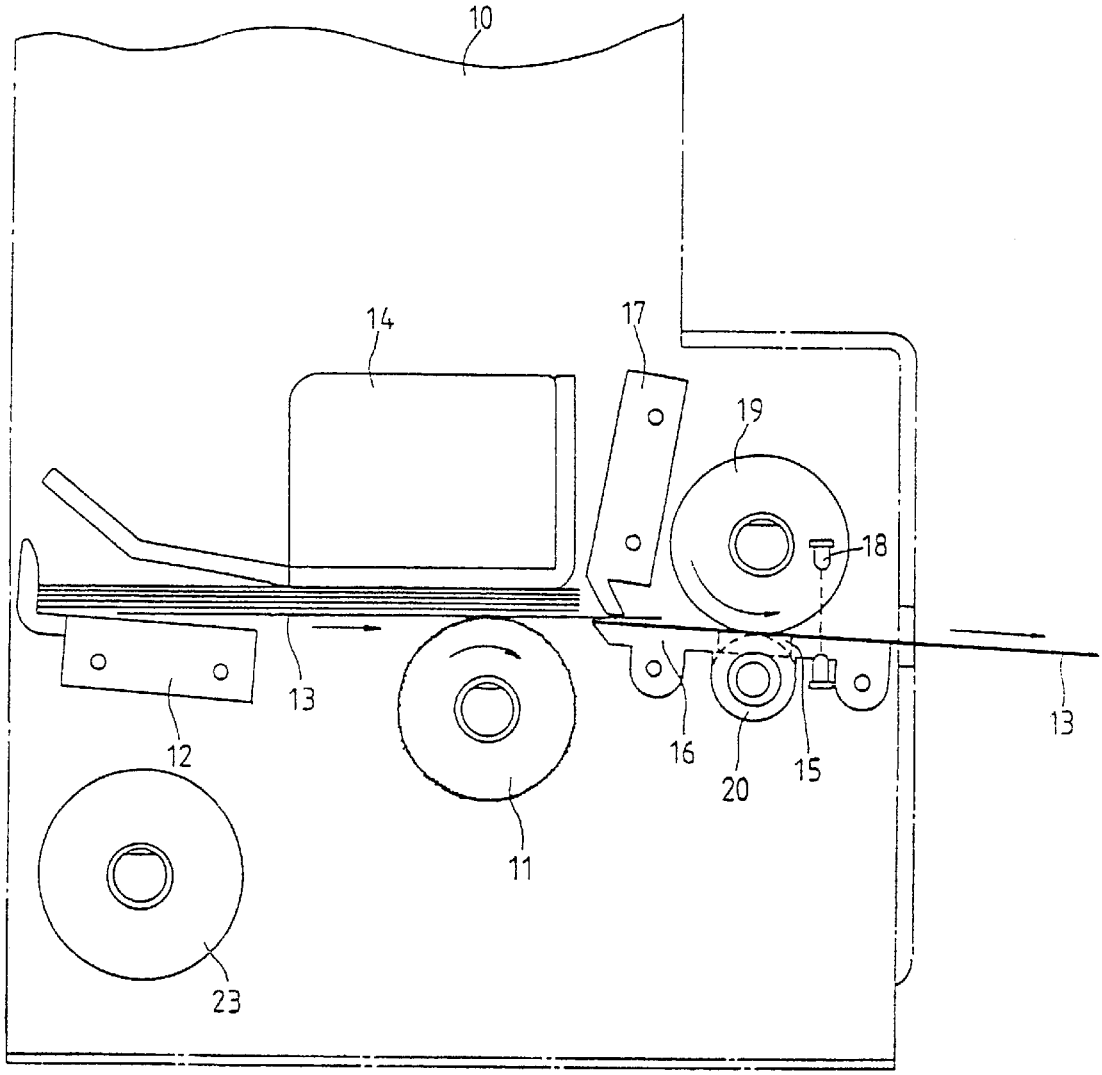
FIG.3(PRIOR ART)
FIG. 3 shows a schematic view of the prior art lottery ticket dispensing machine at work.
Figure 4:
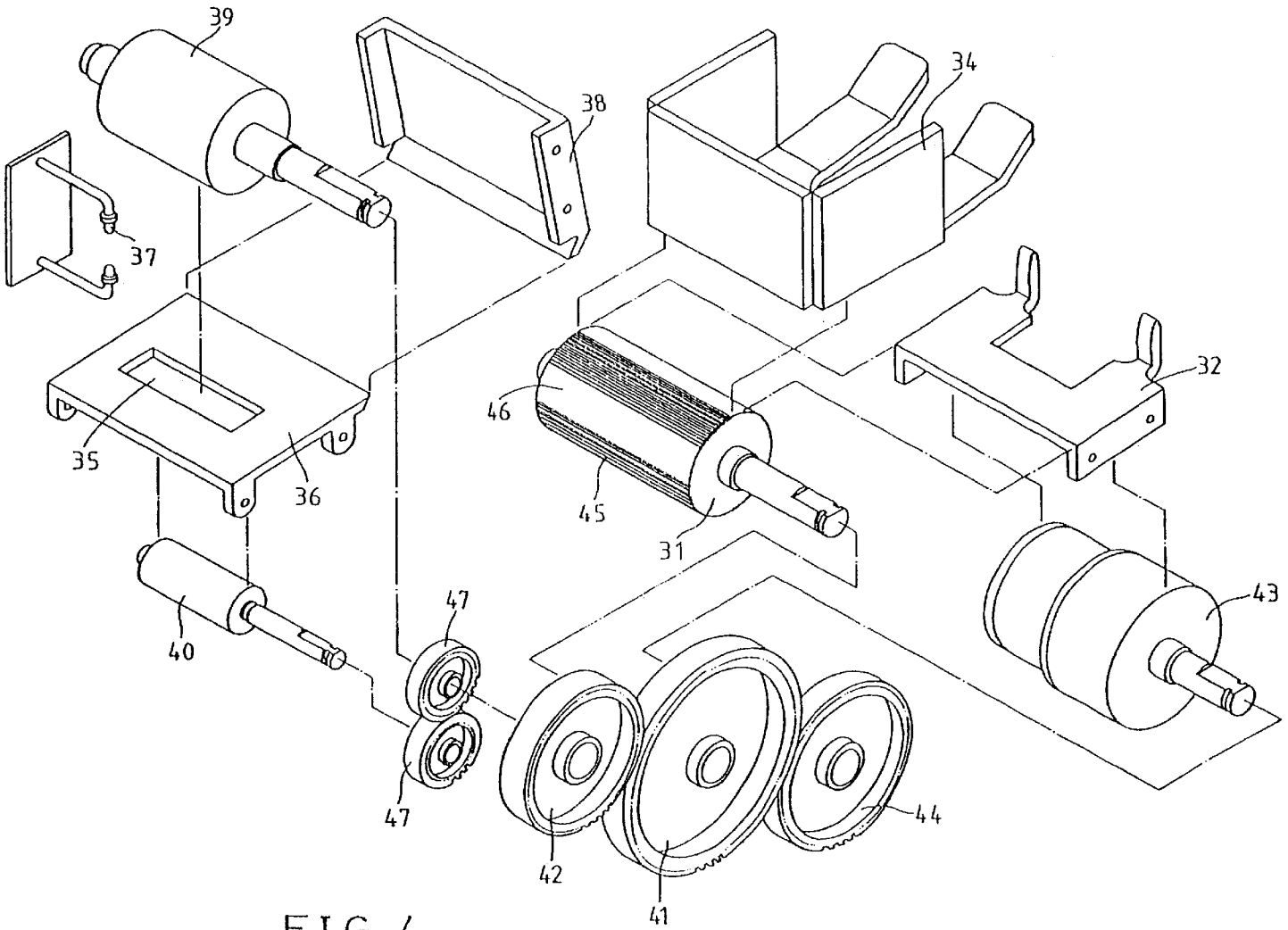
FIG. 4 shows an exploded view of a lottery ticket dispensing machine of the present invention.
Figure 5:
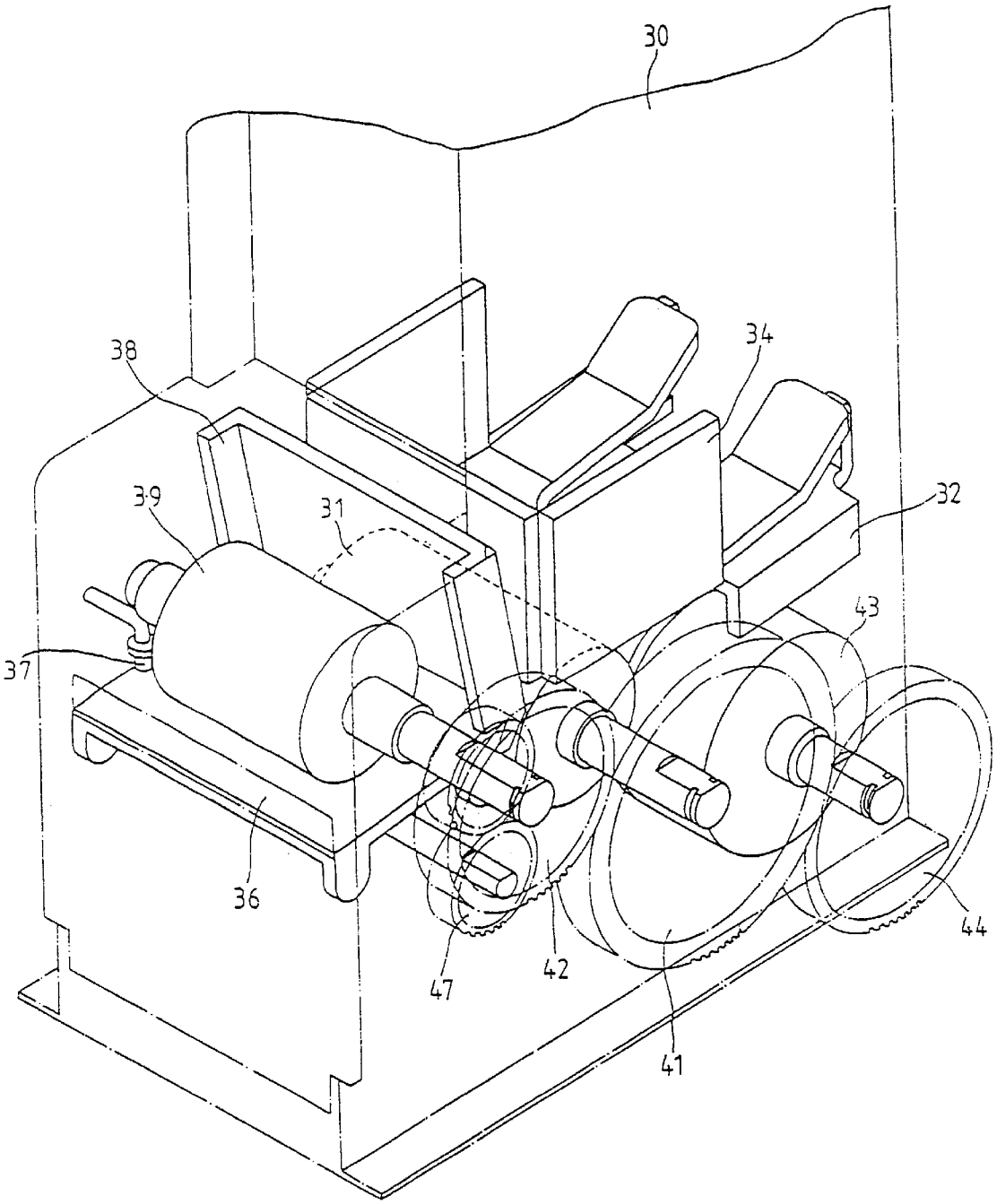
FIG. 5 shows a perspective view of the lottery dispensing machine of the present invention.

As shown in FIGS. 4 and 5, a lottery ticket dispensing machine 30 of the present invention comprises a ticket drawing wheel 31, a support base 32, lottery tickets 33, a weight 34, a guide plate 36 having an opening 35, an electronic eye device 37, and a ticket stopping plate 38. The ticket 33 is drawn out between the bottom edge of the ticket stopping plate 38 and the guide plate 36 by the ticket drawing wheel 31. The ticket 33 so drawn out is counted by the electronic eye device 37. Located over the opening 35 are a fast-delivery roller 39 and an auxiliary roller 40 for dispensing the ticket 33. The ticket drawing wheel 31 and the fast-delivery roller 39 are provided respectively with a large gear 41 and a pinion 42 engageable with the large gear 41 which is driven by the drive gear 44 of a motor 43. As a result, the differential effect is brought about by the fast-delivery roller 39 capable of rotating at a faster speed than the ticket drawing wheel 31.

The drawing wheel 31 is provided with friction surfaces 45 and smooth surfaces 46, which are arranged alternately to facilitate the sliding of the lottery ticket 33 in an intermittent manner. In addition, the prompt dispensing of the lottery ticket 33 is made possible by two gears 47 of the fast-delivery roller 39 and the auxiliary roller 40. The gears 47 are similar in size and engageable with each other.

Figure 6:
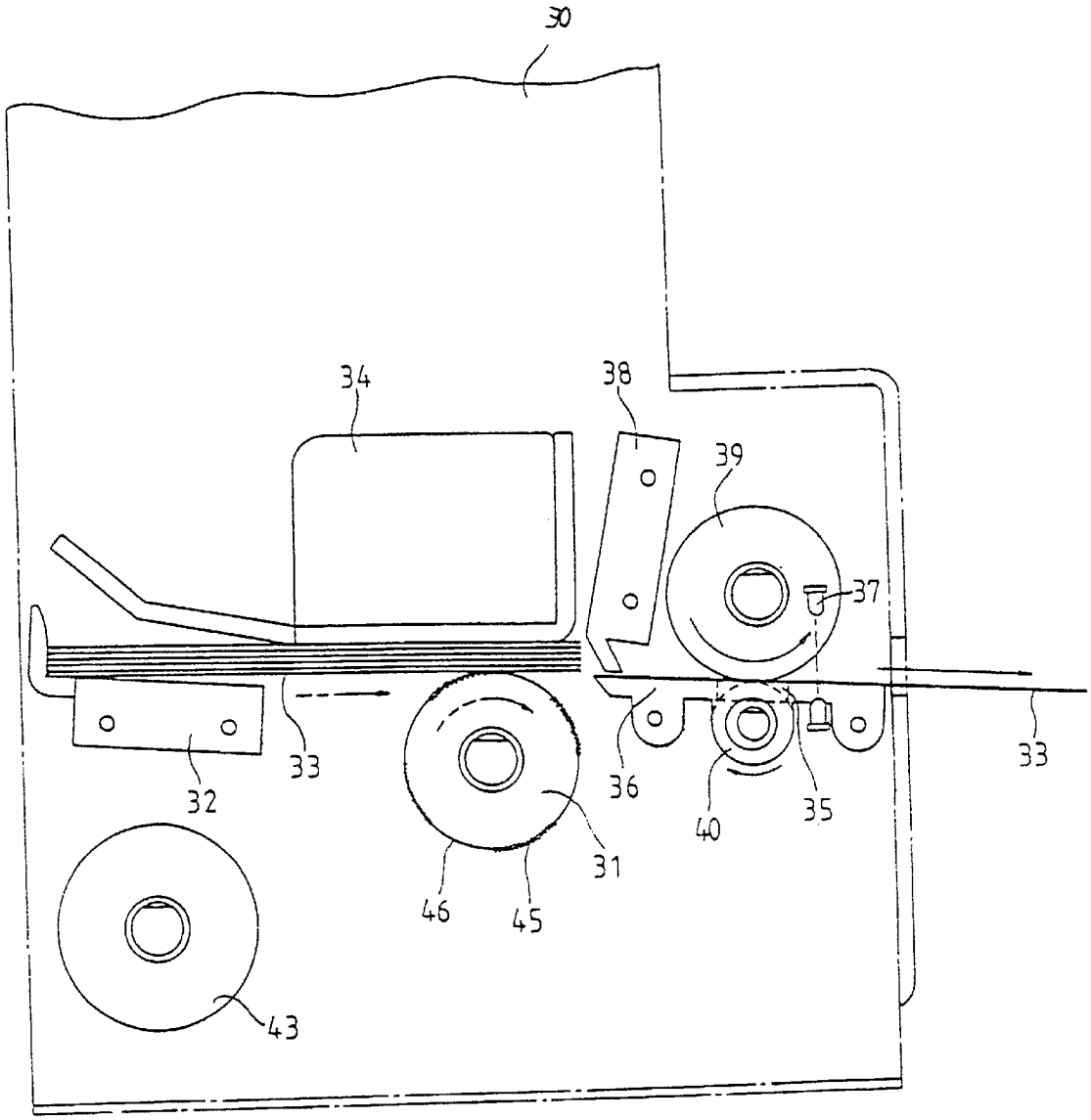
FIG. 6 shows a schematic view of the lottery ticket dispensing machine of the present invention at work.

As shown in FIG. 6, when the motor 43 of the lottery ticket dispensing machine 30 of the present invention is started, the lottery ticket 33 is drawn out by the ticket drawing wheel 31 and is forwarded in an intermittent manner to prevent two or more lottery tickets 33 from being drawn out and forwarded in an overlapping manner. As soon as the lottery ticket 33 is drawn out between the bottom edge of the ticket stopping plate 38 and the guide Plate 36, the lottery ticket 33 is dispensed quickly by the fast-delivery roller 39 and the auxiliary roller 40. In the course of being dispensed, the lottery ticket 33 is counted by the electronic eye device 37. In view of the differential effect brought about by the fast-delivery roller 39 and the ticket drawing wheel 31, and the intermittent action of the drawing wheel 31 on the lottery ticket 33, the following lottery ticket 33 is drawn out and dispensed at an appropriate interval so as to ensure that the counts of the dispensed lottery tickets 33 are correctly registered by the electronic eye device 37. In addition, the dispensing of the lottery tickets 33 is accelerated by means of two gears 47 of the fast-delivery roller 39 and the auxiliary roller 40, which rotate synchronously.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A lottery ticket dispensing device comprising:

a support base;

a weight supported above said support base;

a plurality of lottery tickets interposed between said support base and said weight;

a guide plate having an opening formed therein, said guide plate positioned forward of said support base;

a ticket stopping plate positioned between said weight and said guide plate;

an electronic eye means positioned adjacent said opening of said guide plate, said electronic eye means for detecting one of said plurality of lottery tickets passing across said opening;

a fast delivery roller means positioned above said guide plate for moving said one of said plurality of lottery tickets across said opening of said guide plate;

an auxiliary roller positioned below said guide plate and cooperative with said fast delivery roller means such that said one of said plurality of lottery tickets is moved between said fast delivery roller means and said auxiliary roller;

a motor means linked to said fast delivery roller means and said auxiliary roller for driving at least one of said fast delivery roller means and said auxiliary roller; and a drawing wheel mounted below said plurality of lottery tickets and linked to said motor means, said drawing wheel having a cylindrical configuration with a round exterior surface, said exterior surface having a plurality of friction surfaces and a plurality of smooth surfaces arranged alternately therearound, said motor means for rotating said drawing wheel so as to intermittently move said one of said plurality of lottery tickets toward said fast delivery roller means, said motor means for rotating said drawing wheel at a rate that is slower than a rate of rotation of said fast delivery roller means.

2. The device of claim 1, further comprising:

a first gear connected to said fast delivery roller means;

a second gear connected to said auxiliary roller, said second gear engaged with said first gear such that said fast delivery roller means rotates synchronously with said auxiliary roller.

* * * * *